US006788041B2

(12) United States Patent
Gheorghe et al.

(10) Patent No.: US 6,788,041 B2
(45) Date of Patent: Sep. 7, 2004

(54) LOW POWER BANDGAP CIRCUIT

(76) Inventors: Ionel Gheorghe, 2660 Norberry Crescent, Apt. 1, Ottawa, Ontario (CA); Florinel G. Balteanu, 69 Kimberwick Crescent, Ottawa, Ontario (CA)

( * ) Notice: Subject to any disclaimer, the term of this patent is extended or adjusted under 35 U.S.C. 154(b) by 193 days.

(21) Appl. No.: 10/008,442

(22) Filed: Dec. 6, 2001

(65) Prior Publication Data

US 2003/0107360 A1 Jun. 12, 2003

(51) Int. Cl.[7] ..... G05F 3/16; G05F 3/20

(52) U.S. Cl. ..... 323/313; 323/316; 323/315

(58) Field of Search ..... 323/313, 314, 323/316, 315

(56) References Cited

U.S. PATENT DOCUMENTS

| | | | | | |
|---|---|---|---|---|---|
| 5,440,224 | A | * | 8/1995 | Kimura | 323/313 |
| 5,627,461 | A | * | 5/1997 | Kimura | 323/312 |
| 5,926,062 | A | * | 7/1999 | Kuroda | 327/538 |
| 6,016,051 | A | * | 1/2000 | Can | 323/315 |
| 6,137,341 | A | * | 10/2000 | Friedman et al. | 327/513 |
| 6,437,550 | B2 | * | 8/2002 | Andoh et al. | 323/315 |
| 6,528,979 | B2 | * | 3/2003 | Kimura | 323/313 |
| 6,531,857 | B2 | | 3/2003 | Ju | 323/316 |

OTHER PUBLICATIONS

Widlar, R. J.: "A New Breed of Linear ICs Run at 1–Volt Levels," *Electronics*, Mar. 29, 1979, pp. 115–119.

Brokaw, A. P.: "a Simple Three Terminal IC Bandgap Reference," *IEEE Journal of Solid–State Circuits*, 1974, SC–9 (6), pp. 667–670.

Vittoz, E. A. and Neyroud, O.: "A Low–Voltage CMOS Bandgap Reference," *IEEE Journal of Solid–State Circuits*, 1979, SC–14(3), pp. 573–577.

(List continued on next page.)

*Primary Examiner*—Bao Q. Vu
(74) *Attorney, Agent, or Firm*—Thomas, Kayden, Horstemeyer & Risley

(57) ABSTRACT

A bandgap reference circuit for generating a reference voltage includes a transistor, a bias current source for generating a bias current, a proportional to absolute temperature (PTAT) current source for generating a PTAT current, a first resistor, and a second resistor. The transistor generates a base-emitter voltage that is divided at an output node through the first and second resistors. The first resistor couples between the collector of the transistor and the output node. The second resistor couples between the output node and ground. The bias current source supplies the bias current to the transistor and the PTAT current source supplies a PTAT current to output node 105. The reference voltage may be obtained at output node as a result of combining a portion of the base-emitter voltage, which has a negative temperature coefficient, with a PTAT voltage that is obtained by sensing a portion of the PTAT current over the second resistor.

19 Claims, 6 Drawing Sheets

OTHER PUBLICATIONS

Gunawan, M., Meijer, G.C.M., Fonderie, J., and Huijsing, J.H.: "A Curvature–Corrected Low–Voltage Bandgap Reference," *IEEE Journal of Solid State Circuits*, 1993, SC–28 (6), pp. 667–670.

Jiang, Y., and Lee, E.K.F.: "Design of Low–Voltage Bandgap Reference Using Transimpedance Amplifier," *IEEE Transactions on Circuits and Systems II: Analog and Digital Signal Processing*, 2000, vol. 47 (6), pp. 667–670.

Banba, H., Shiga, H., Umezawa, A., Miyaba, T., Tanzawa, T., Atsumi, S., and Sakui, K.: "A CMOS Bandgap Reference Circuit with Sub IV Operation," *IEEE Journal of Solid–State Circuits*, 1999, SC–34 (5) pp. 670–674.

Filiol, N., Birkett, N., Cherry, J., Balteanu, F., Cojocaru, C., Namdar, A., Pamir, T., Sheikh, K., Glandon, G., Payer, D., Swaminathan, A., Forbes, R. Riley, T., Alinoor, S.M., Macrobbie, E., Cloutier, M., Pipilos, S., Varelas, T.: "A 22mW Bluetooth RF Transeeiver with Direct RF Modulation and On–chip IF Filtering," 2001 *IEEE International Solid–State Circuits Conference—Digest of Technical Papers*, 2001, pp. 202–203.

Neuteboom, Harry, KUP, Ben M.J., Janssens, Mark. A DSP–Based Hearing Instrument IC. IEEE Journal of Solid States Circuits, vol. 32, No. 11, pp. 1790–1806, Nov. 1997.

* cited by examiner

LOW POWER BANDGAP CIRCUIT

BACKGROUND OF THE INVENTION

1. Field of the Invention

The present invention relates to reference voltage circuits and, in particular, to a bandgap reference voltage circuit characterized by low power consumption.

2. Related Art

Portable wireless systems have increased the demand for analog circuits which are powered by a low voltage source. Most of these analog circuits use a bandgap reference circuit that generates a constant voltage by summing two currents or voltages, one that is proportional to absolute temperature (PTAT) and another that is complementary to absolute temperature (CTAT). The sum of these currents or voltages can be temperature independent and can be used to obtain a reference voltage, usually referred to as a bandgap reference voltage. This technique usually requires a relatively high power supply voltage of approximately 2.5V–3.3V and a power supply current of about 100 $\mu$A. Examples of bandgap reference circuits are described in Widlar, "*A new breed of linear ICs run at* 1-*volt levels*," Electronics, Mar. 29, 1979, pp. 115–119, and Brokaw, "*A simple three terminal IC bandgap reference*," IEEE Journal of Solid-State Circuits, 1974, SC-9 (6), pp.667–670.

Recently, various techniques have been proposed for designing reference voltage circuits that provide precise reference voltages and that operate at low supply voltages. A main emphasis in designing such circuits has been reducing the reference voltage and the power consumption. Such circuit design techniques are described in the following articles: Vittoz et al., "*A Low-Voltage CMOS Bandgap Reference*," IEEE Journal Of Solid-State Circuits, 1979, SC-14, No. 3, pp.573–577; Gunawan et al., "*A Curvature-Corrected Low-Voltage Bandgap Reference*," IEEE Journal Of Solid State Circuits, 1993, Vol. 28, No. 6, pp.667–670; Jiang et al., "*Design Of Low-Voltage Bandgap Reference Using Transimpedance Amplifier*," IEEE Transactions On Circuits And Systems-II: Analog And Digital Signal Processing, 2000, Vol.47, No. 6, pp.667–670; Banba et al., "*A CMOS Bandgap Reference Circuit With Sub*-1-*V Operation*," IEEE Journal Of Solid-State Circuits, 1999, Vol. 34, No. 5, pp.670–674. None of these references, however, disclose a reference voltage circuit that is simple and cost effective, and that has very low power consumption. Therefore, what is needed is a simple and cost effective circuit that provides a precise reference voltage and that has very low power consumption.

SUMMARY

In one embodiment of the present invention, a bandgap reference circuit includes a bias current source, a transistor, a first resistor, a second resistor, and a proportional to absolute temperature (PTAT) current source. The transistor has an emitter, a collector, and a base. The collector is coupled to the bias current source and to the first resistor. The first resistor is coupled between the collector and the second resistor. The PTAT current source provides a PTAT current to an output node between the first resistor and the second resistor.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION

Figure 1A:
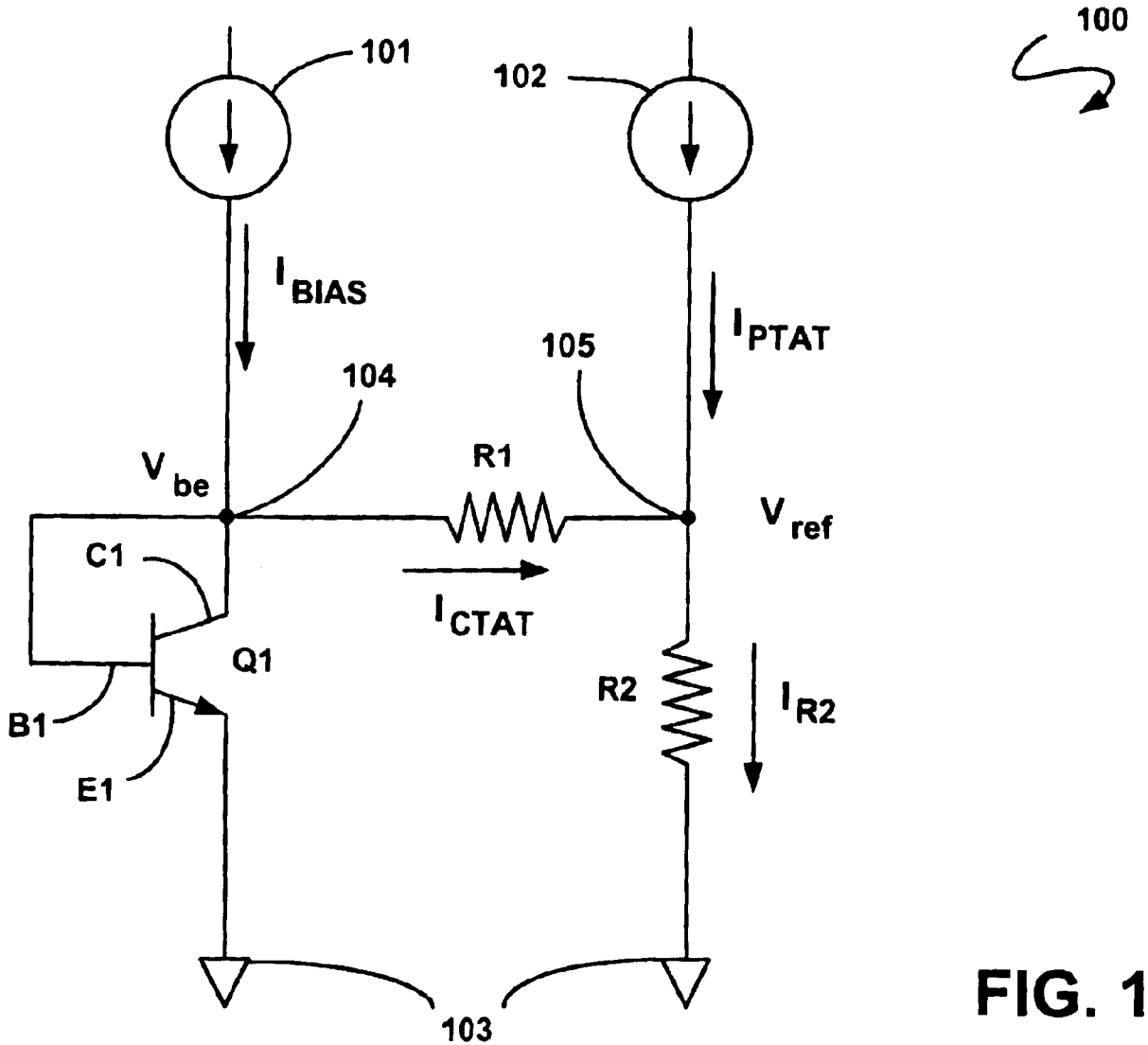
FIG. 1A is a schematic diagram illustrating a bandgap reference circuit for generating a reference voltage $V_{ref}$ in accordance with one embodiment of the invention.

FIG. 1A is a schematic diagram illustrating a bandgap reference circuit 100 for generating a reference voltage $V_{ref}$ in accordance with one embodiment of the invention. Circuit 100 includes a transistor Q1, a bias current source 101 for generating a bias current $I_{BIAS}$, a proportional to absolute temperature (PTAT) current source 102 for generating a PTAT current $I_{PTAT}$, a first resistor R1, and a second resistor R2. Transistor Q1, which can be any type of bipolar transistor (e.g. pnp or npn), has a base terminal B1, a collector terminal C1, and an emitter terminal E1. Base terminal B1 is coupled to collector terminal C1, whereas emitter terminal E1 is coupled to ground 103. Transistor Q1 generates a base-emitter voltage ($V_{be}$) that is divided at output node 105 through resistors R1 and R2. Resistor R1 couples between the terminal C1 and output node 105. Resistor R2 couples between output node 105 and ground 103. Bias current source 101 supplies bias current $I_{BIAS}$ to terminals B1 and C1, and current source 102 supplies PTAT current $I_{PTAT}$ to output node 105.

The voltage $V_{be}$ causes a CTAT current $I_{CTAT}$ to flow from node 104 to node 105. The current $I_{CTAT}$ and a portion of current $I_{PTAT}$ combine to form a current $I_{R2}$ which flows through resistor R2 to generate reference voltage $V_{ref}$ at output node 105. The reference voltage $V_{ref}$ is therefore made up of two components: a CTAT voltage $V_{CTAT}$ that is proportional to $V_{be}$ and a PTAT voltage $V_{PTAT}$ that is proportional to $I_{PTAT}$. The value for the reference voltage $V_{ref}$ can be determined as follows:

$$V_{ref} = V_{CTAT} + V_{PTAT} \quad \text{(EQ. 1)}$$

$$= \frac{R2}{R1 + R2} \cdot V_{be} + \frac{R1 \cdot R2}{R1 + R2} \cdot I_{PTAT}$$

By choosing suitable values for resistors R1 and R2 and for the PTAT current $I_{PTAT}$, the reference voltage $V_{ref}$ can be maintained at a substantially constant level regardless of variations in the temperature of the circuit.

Figure 1B:
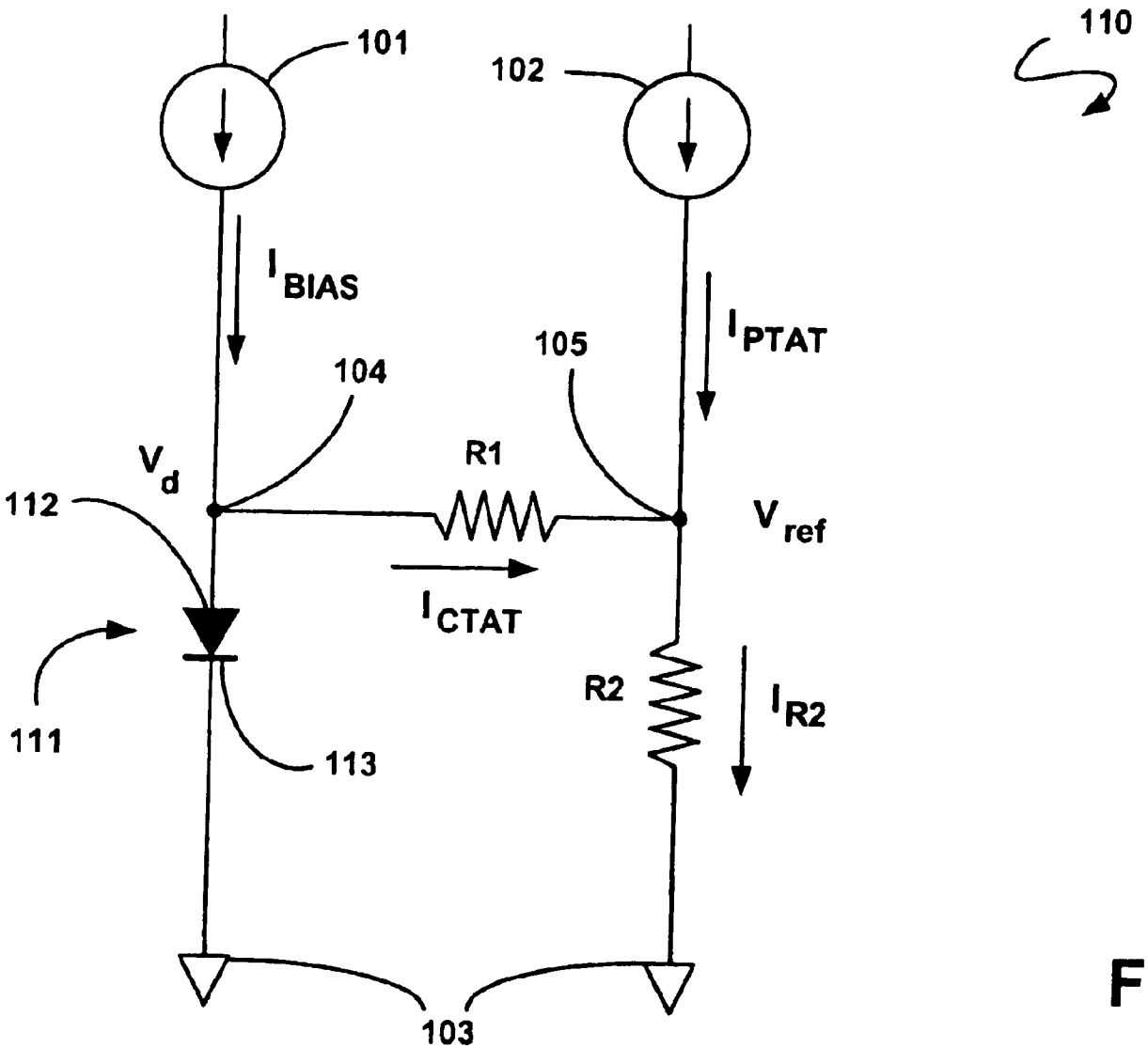
FIG. 1B is a schematic diagram illustrating a bandgap reference circuit that is an alternative embodiment to the bandgap reference circuit illustrated in FIG. 1A.

FIG. 1B is a schematic diagram illustrating a bandgap reference circuit 110 that is an alternative embodiment to the bandgap reference circuit 100 illustrated in FIG. 1A. Circuit 110 includes a diode 111 having an anode 112 that is coupled to bias current source 101, and a cathode 113 that is coupled to ground 103. Resistor RI couples between anode 112 and output node 105. Resistor R2 couples between output node 105 and ground 103. Current source 101 supplies bias current $I_{BIAS}$ to anode 112, and current source 102 supplies PTAT current $I_{PTAT}$ to output node 105. Diode 111 generates a diode voltage $V_d$ that causes a CTAT current $I_{CTAT}$ to flow from node 104 to node 105. The current $I_{CTAT}$ and a portion of the current $I_{PTAT}$ combine to form a current $I_{R2}$ that flows through resistor R2 thereby generating reference voltage $V_{ref}$ at output node 105. The value for the reference voltage $V_{ref}$ can be determined as follows:

$$V_{ref} = \frac{R2}{R1+R2} \cdot V_d + \frac{R1 \cdot R2}{R1+R2} \cdot I_{PTAT} \quad \text{(EQ. 2)}$$

Figure 2:
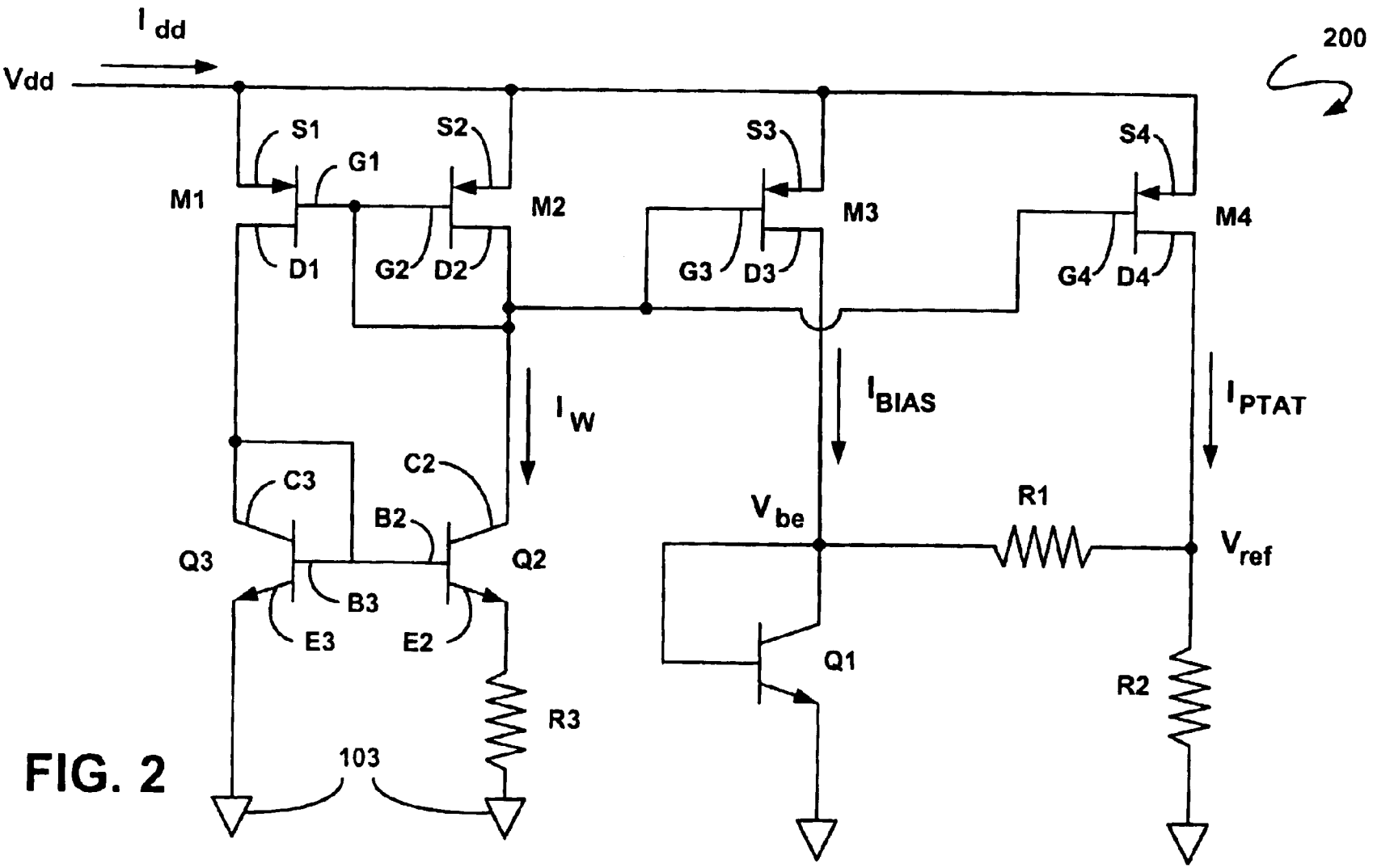
FIG. 2 is a schematic diagram of a bandgap reference circuit illustrating one possible approach for generating the bias current and the proportional to absolute temperature (PTAT) current depicted in FIGS. 1A and 1B.

FIG. 2 is a schematic diagram of a bandgap reference circuit 200 illustrating one possible approach for generating currents $I_{BIAS}$ and $I_{PTAT}$. The bandgap reference circuit 200 has relatively few components and is suitable for large-scale integration. Those having ordinary skill in the art will appreciate that other approaches may also be used to generate currents $I_{BIAS}$ and $I_{PTAT}$. The bandgap reference circuit 200 includes resistors R1, R2, and R3 and transistors M1, M2, M3, M4, Q1, Q2, and Q3. Transistors M1, M2, M3, and M4 comprise respective gate terminals G1, G2, G3, and G4, respective source terminals S1, S2, S3, and S4, and respective drain terminals D1, D2, D3, and D4. Transistors Q2 and Q3 comprise respective base terminals B2 and B3, respective emitter terminals E2 and E3 and respective collector terminals C2 and C3. Each of transistors M1 through M4 is preferably a positive channel metal-oxide-semiconductor field-effect transistor (p-channel MOSFET), but may, in an alternative embodiment, be replaced with any suitable transistor such as, for example, a bipolar transistor. Transistors Q1, Q2, and Q3, on the other hand, are preferably bipolar transistors, although transistors Q1 and Q3 may be replaced with bipolar diodes. The base terminal B3 is coupled to the collector terminal C3, to base terminal B2, and to drain terminal D1. Resistor R3 couples between emitter terminal E2 and ground 103. Gate terminals G1, G2, G3, and G4 are coupled to one another, to collector terminal C2, and to drain terminal D2. Source terminals S1, S2, S3, and S4 are coupled to one another and to a voltage source $V_{dd}$ that provides a supply current $I_{dd}$. Other components such as transistor Q1, resistor R1, and resistor R2 are coupled as described above with reference to FIG. 1A.

Transistors Q2 and Q3 create a Widlar PTAT current $I_W$ The value of the current $I_W$ can be determined as follows:

$$I_W = \frac{k \cdot T}{q \cdot R3} \cdot \ln\frac{A2}{A3} \quad \text{(EQ. 3)}$$

where k=Boltzmann's constant, T=absolute temperature in °K; q=the charge of an electron, A2 is the interface area between the emitter terminal and the base terminal of transistor Q2, and A3 is the interface area between the emitter terminal and the base terminal of transistor Q3. The value of kT/q is commonly referred to as the thermal voltage $V_T$ and is temperature dependant. Transistors M2, M3, and M4 act as a current mirror that produces currents $I_{BIAS}$ and $I_{PTAT}$. Currents $I_{BIAS}$ and $I_{PTAT}$ are related to current $I_W$ as follows:

$$I_{PTAT} = I_W \cdot \frac{W4 \cdot L2}{W2 \cdot L4} \quad \text{(EQ. 4)}$$

$$I_{BIAS} = I_W \cdot \frac{W3 \cdot L2}{W2 \cdot L3} \quad \text{(EQ. 5)}$$

The terms W2, W3, and W4 represent the widths of gate terminals G2, G3, and G4, respectively, and the terms L2, L3, and L4 represent the lengths of gate terminals G2, G3, and G4, respectively.

Figure 3:
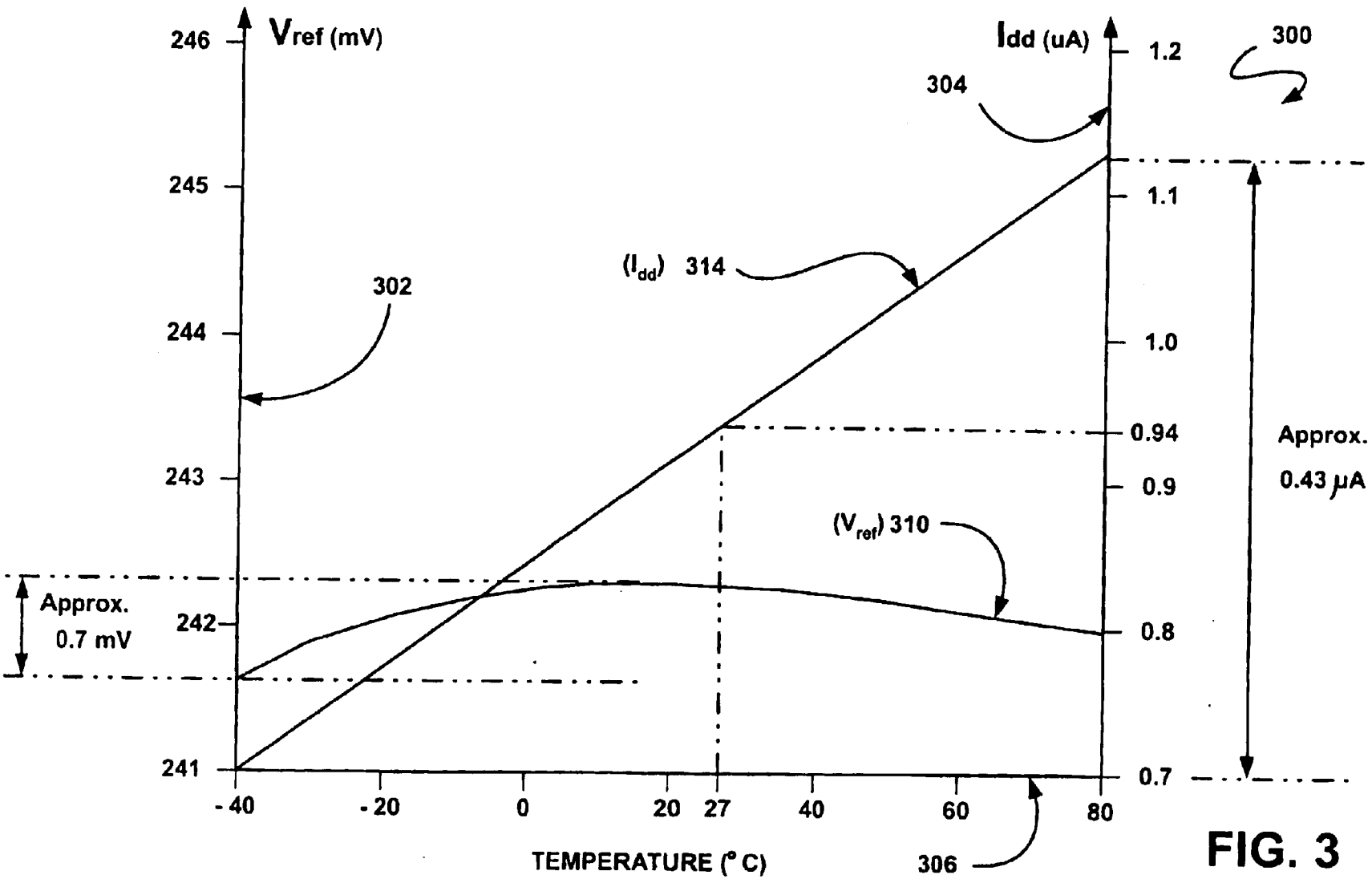
FIG. 3 is a graph depicting variations in the reference voltage $V_{ref}$ and in the power supply current $I_{dd}$ for a bandgap reference circuit using a voltage source $V_{dd}$ equal to 1.0V.
Figure 4:
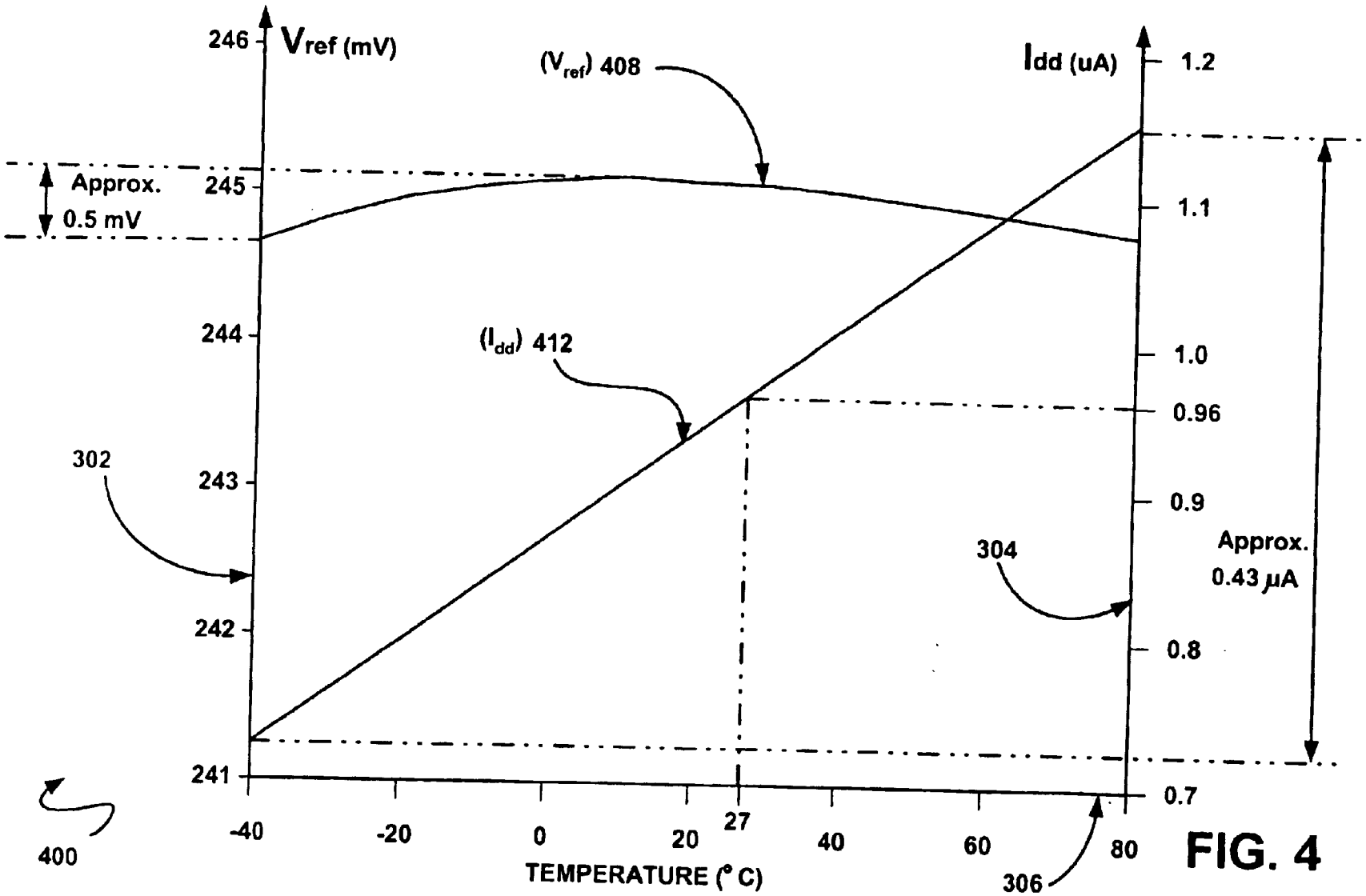
FIG. 4 is a graph depicting variations in the reference voltage $V_{ref}$ and in the power supply current $I_{dd}$ for a bandgap reference circuit using a voltage source $V_{dd}$ equal to 1.2V.

FIGS. 3 and 4 are graphical illustrations collectively depicting non-limiting examples of simulations for bandgap reference circuit 200 (FIG. 2), where transistors Q1, Q2, and Q3 are silicon-germanium (SiGe) bipolar transistors. These graphical illustrations show that the bandgap reference circuit 200 can provide a reference voltage $V_{ref}$ that is substantially constant in response to variations in temperature, while drawing a supply current $I_{dd}$ of less than 1 $\mu$A. It should be emphasized that in alternative embodiments of the invention, each of the transistors Q1, Q2, and Q3 may be any suitable type of bipolar transistor.

FIG. 3 is a graphical illustration 300 depicting variations in the reference voltage $V_{ref}$ and in the supply current $I_{dd}$ for a bandgap reference circuit 200 using a voltage source $V_{dd}$ equal to 1.0V. The first vertical axis 302 represents the output voltage $V_{ref}$ in mV, the second vertical axis 304 represents the supply current $I_{dd}$ in $\mu$A and the horizontal axis 306 represents the circuit temperature in ° C. The line segment 310 represents a plot of the output voltage $V_{ref}$ and the line segment 314 represents a plot of the supply current $I_{dd}$. As shown in FIG. 3, the simulated reference voltage $V_{ref}$ varies by about 0.7 mV and the simulated supply current $I_{dd}$ varies by about 0.43 $\mu$A over a temperature range of −40° C. to 80° C. At a temperature of approximately 27° C. (room temperature), circuit 200 draws a supply current $I_{dd}$ of about 0.94 $\mu$A from a voltage source $V_{dd}$ equal to 1.0V. Therefore, the amount of power consumed at room temperature is only about 0.94 $\mu$W (0.94 $\mu$A times 1.0V).

FIG. 4 is a graphical illustration 400 depicting variations in the reference voltage $V_{ref}$ and in the supply current $I_{dd}$ for a bandgap reference circuit 200 using a voltage source $V_{dd}$ equal to 1.2V. Line segments 408 and 412 represent plots of the output voltage $V_{ref}$ and the supply current $I_{dd}$, respectively, over temperature. As shown in FIG. 4, the simulated reference voltage $V_{ref}$ varies by about 0.5 mV and the simulated supply current $I_{dd}$ varies by about 0.43 $\mu$A over a temperature range of −40° C. to 80° C. At a temperature of 27° C., circuit 200 draws a supply current $I_{dd}$ of about 0.96 $\mu$A. Therefore, the amount of power consumed at room temperature is only about 1.15 $\mu$W (0.96 $\mu$A times 1.2V).

Figure 5:
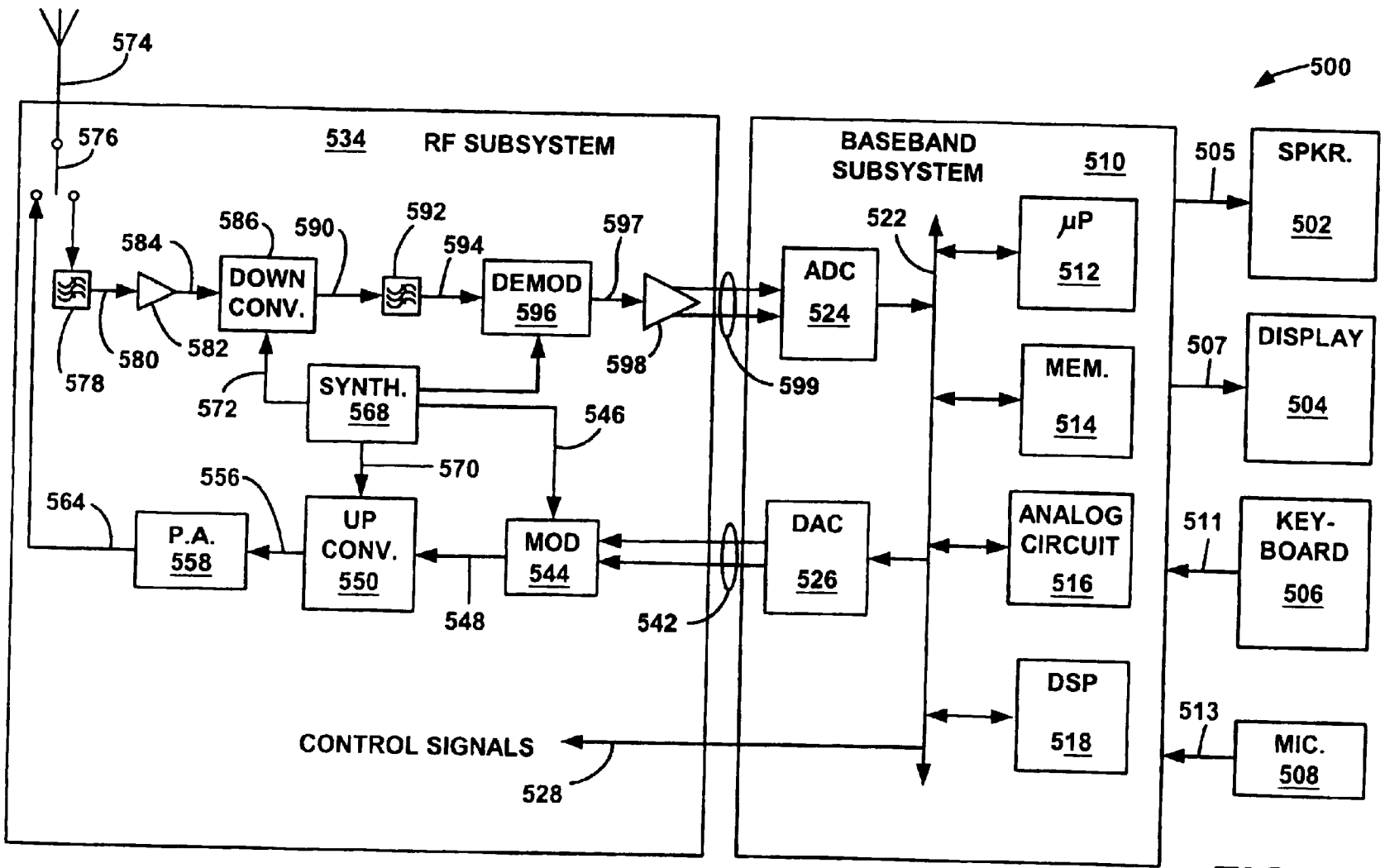
FIG. 5 is a block diagram illustrating a non-limiting example of a simplified portable transceiver in which an embodiment of the invention may be implemented.

FIG. 5 is a block diagram illustrating a non-limiting example of a simplified portable transceiver 500 in which embodiments of the bandgap reference circuits 100, 110, and 200 (FIGS. 1A, 1B, and 2) may be implemented. The bandgap reference circuit 100 may be used to provide a voltage $V_{ref}$ to many of the components of transceiver 500 including, for example, analog-to-digital converter 524, digital-to-analog converter 526, modulator 544, upconverter 550, synthesizer 568, power amplifier 558, receive filter 578, low noise amplifier 582, downconverter 586, channel filter 592, demodulator 596, and amplifier 598. It should be emphasized that systems and methods of the invention are not limited to the portable transceiver 500 or to wireless communications devices. Other devices that may incorporate an embodiment of the invention include, for example, dynamic random access memories (DRAMs).

The portable transceiver 500 includes speaker 502, display 504, keyboard 506, and microphone 508, all connected to baseband subsystem 510. In a particular embodiment, the portable transceiver 500 can be, for example, but not limited to, a portable telecommunication handset such as a mobile cellular-type telephone. Speaker 502 and display 504 receive signals from baseband subsystem 510 via connections 505 and 507, respectively. Similarly, keyboard 506 and microphone 508 supply signals to baseband subsystem 510 via connections 511 and 513, respectively. Baseband subsystem 510 includes microprocessor ($\mu$P) 512, memory 514, analog circuitry 516 and digital signal processor (DSP) 518, each coupled to a data bus 522. Data bus 522, although shown as a single bus, may be implemented using multiple busses connected as necessary among the subsystems within baseband subsystem 510. Microprocessor 512 and memory 514 provide signal timing, processing and storage functions for portable transceiver 500. Analog circuitry 516 provides the analog processing functions for the signals within baseband subsystem 510. Baseband subsystem 510 provides control signals to radio frequency (RF) subsystem 534 via connection 528. Although shown as a single connection 528, the control signals may originate from DSP 518 or from microprocessor 512, and may be supplied to a variety of points within RF subsystem 534. It should be noted that, for simplicity, only selected components of a portable transceiver 500 are illustrated in FIG. 5.

Baseband subsystem 510 also includes analog-to-digital converter (ADC) 524 and digital-to-analog converter (DAC) 526. ADC 524 and DAC 526 communicate with microprocessor 512, memory 514, analog circuitry 516 and DSP 518 via data bus 522. DAC 526 converts digital communication information within baseband subsystem 510 into an analog signal for transmission to RF subsystem 534 via connection 542.

RF subsystem 534 includes modulator 544, which, after receiving an LO signal from synthesizer 568 via connection 546, modulates the received analog information and provides a modulated signal via connection 548 to upconverter 550. Upconverter 550 also receives a frequency reference signal from synthesizer 568 via connection 570. Synthesizer 568 determines the appropriate frequency to which upconverter 550 will upconvert the modulated signal on connection 548.

Upconverter 550 supplies a phase-modulated signal via connection 556 to power amplifier 558. Power amplifier 558 amplifies the modulated signal on connection 556 to the appropriate power level for transmission via connection 564 to antenna 574. Illustratively, switch 576 controls whether the amplified signal on connection 564 is transferred to antenna 574 or whether a received signal from antenna 574 is supplied to filter 578. The operation of switch 576 is controlled by a control signal from baseband subsystem 510 via connection 528. Alternatively, the switch 576 may be replaced with circuitry to enable the simultaneous transmission and reception of signals to and from antenna 574.

A signal received by antenna 574 will, at the appropriate time determined by baseband system 510, be directed via switch 576 to a receive filter 578. Receive filter 578 filters the received signal and supplies the filtered signal on connection 580 to low noise amplifier (LNA) 582. Receive filter 578 is a bandpass filter, which passes all channels of the particular cellular system in which the portable transceiver 500 is operating. As an example, for a Global System For Mobile Communications (GSM) 900 MHz system, receive filter 578 would pass all frequencies from 935.1 MHz to 959.9 MHz, covering all 524 contiguous channels of 200 kHz each. The purpose of this filter is to reject all frequencies outside the desired region. LNA 582 amplifies the weak signal on connection 580 to a level at which downconverter 586 can translate the signal from the transmitted frequency back to a baseband frequency. Alternatively, the functionality of LNA 582 and downconverter 586 can be accomplished using other elements, such as for example but not limited to, a low noise block downconverter (LNB).

Downconverter 586 receives an LO signal from synthesizer 568, via connection 572. The LO signal is used in the downconverter 586 to downconvert the signal received from LNA 582 via connection 584. The downconverted frequency is called the intermediate frequency ("IF"). Downconverter 586 sends the downconverted signal via connection 590 to channel filter 592, also called the "IF filter." Channel filter 592 filters the downconverted signal and supplies it via connection 594 to demodulator 596. The channel filter 592 selects one desired channel and rejects all others. Using the GSM system as an example, only one of the 524 contiguous channels would be selected by channel filter 592. The synthesizer 568, by controlling the local oscillator frequency supplied on connection 572 to downconverter 586, determines the selected channel. Demodulator 596 recovers the transmitted analog information and supplies a signal representing this information via connection 597 to amplifier 598. Amplifier 598 amplifies the signal received via connection 597 and supplies an amplified signal via connection 599 to ADC 524. ADC 524 converts these analog signals to a digital signal at baseband frequency and transfers it via data bus 522 to DSP 518 for further processing.

While various embodiments of the invention have been described, it will be apparent to those of ordinary skill in the art that many more embodiments and implementations are possible that are within the scope of this invention.

What is claimed is:

1. A bandgap reference circuit comprising:

a diode having an anode and a cathode;

a first resistor and a second resistor, where the first resistor is coupled between the anode and the second resistor;

a proportional to absolute temperature (PTAT) current source for providing a PTAT current, where the PTAT current source is coupled to a node between the first resistor and the second resistor;

where a reference voltage is generated at the node between the first resistor and the second resistor.

2. The bandgap reference circuit of claim 1, further comprising:

a bias current source for providing a bias current to the diode.

3. The bandgap reference circuit of claim 1, where the second resistor couples between the first resistor and ground.

4. The bandgap reference circuit of claim 1, where the emitter is coupled to ground.

5. The bandgap reference circuit of claim 1, where the reference voltage remains substantially constant in response to variations in temperature.

6. A bandgap reference circuit comprising:

a first transistor having an emitter, a collector, and a base, wherein the base is coupled to the collector, and wherein the emitter is coupled to ground;

a first resistor and a second resistor, wherein the first resistor is coupled between the collector and the second resistor, and wherein the second resistor is coupled between the first resistor and ground;

a proportional to absolute temperature (PTAT) current source for providing a PTAT current, wherein the PTAT current source is coupled to a node between the first resistor and the second resistor;

wherein a reference voltage is generated at the node between the first resistor and the second resistor.

7. The bandgap reference circuit of claim 6, further comprising a bias current source for providing a bias current to the transistor.

8. The bandgap reference circuit of claim 6, where the reference voltage remains substantially constant in response to variations in temperature.

9. The bandgap reference circuit of claim 6, where the transistor is a bipolar transistor.

10. The bandgap reference circuit of claim 6, further comprising a second transistor and a third coupled to each other, wherein a drain terminal of the second transistor is coupled to the collector of the first transistor.

11. The bandgap reference circuit of claim 10, where source terminals of the second and third transistor are coupled to each other.

12. The bandgap reference circuit of claim 11, where a drain terminal of the third transistor is coupled to a node between the first and second resistors.

13. The bandgap reference circuit of claim 12, further comprising a fourth and a fifth transistor, wherein gate terminals of the second, third, fourth, and fifth transistors are coupled to each other.

14. The bandgap reference circuit of claim 13, where the source terminals of the second and the third transistors are coupled to source terminals of the fourth and fifth transistors.

15. The bandgap reference circuit of claim 14, further comprising a sixth and a seventh transistor, wherein a drain terminal of the fourth transistor is coupled to a collector of the sixth transistor, and wherein a drain terminal of the fifth transistor is coupled to a collector of the seventh transistor.

16. The bandgap reference circuit of claim 15, where bases of the sixth and seventh transistors are coupled to each other.

17. The bandgap reference circuit of claim 16, where an emitter of the sixth transistor is coupled to ground.

18. The bandgap reference circuit of claim 17, where an emitter of the seventh transistor is coupled to a third resistor.

19. The bandgap reference circuit of claim 18, where the third resistor is coupled to ground.

* * * * *

UNITED STATES PATENT AND TRADEMARK OFFICE

CERTIFICATE OF CORRECTION

PATENT NO. : 6,788,041 B2
DATED : September 7, 2004
INVENTOR(S) : Gheorghe et al.

It is certified that error appears in the above-identified patent and that said Letters Patent is hereby corrected as shown below:

Title page,
Item [73], Assignee, please add the following information:
-- Skyworks Solutions, Inc., Irvine, CA --

Signed and Sealed this

Seventeenth Day of May, 2005

JON W. DUDAS
*Director of the United States Patent and Trademark Office*